US008682678B2

(12) United States Patent
Malkin et al.

(10) Patent No.: US 8,682,678 B2
(45) Date of Patent: Mar. 25, 2014

(54) AUTOMATIC REALTIME SPEECH IMPAIRMENT CORRECTION

(75) Inventors: Peter K. Malkin, Ardsley, NY (US); Sharon M. Trewin, Croton-on-Hudson, NY (US)

(73) Assignee: International Business Machines Corporation, Armonk, NY (US)

( * ) Notice: Subject to any disclaimer, the term of this patent is extended or adjusted under 35 U.S.C. 154(b) by 122 days.

(21) Appl. No.: 13/420,088

(22) Filed: Mar. 14, 2012

(65) Prior Publication Data

US 2013/0246061 A1 Sep. 19, 2013

(51) Int. Cl.
*G10L 21/00* (2013.01)

(52) U.S. Cl.
USPC ..... 704/278

(58) Field of Classification Search
USPC ..... 704/270, 271, 278; 600/23
See application file for complete search history.

(56) References Cited

U.S. PATENT DOCUMENTS

| | | | | |
|---|---|---|---|---|
| 5,647,834 | A * | 7/1997 | Ron | 600/23 |
| 5,920,838 | A * | 7/1999 | Mostow et al. | 704/255 |
| 5,940,798 | A * | 8/1999 | Houde | 704/271 |
| 5,973,252 | A | 10/1999 | Hildebrand | |
| 6,231,500 | B1 * | 5/2001 | Kehoe | 600/23 |
| 6,754,632 | B1 * | 6/2004 | Kalinowski et al. | 704/271 |
| 7,031,922 | B1 * | 4/2006 | Kalinowski et al. | 704/271 |
| 7,158,933 | B2 | 1/2007 | Balan et al. | |
| 7,271,329 | B2 * | 9/2007 | Franzblau | 84/609 |
| 7,860,719 | B2 * | 12/2010 | Maskey et al. | 704/277 |
| 7,930,168 | B2 * | 4/2011 | Weng et al. | 704/9 |
| 2002/0156627 | A1 * | 10/2002 | Itoh et al. | 704/254 |
| 2003/0115053 | A1 | 6/2003 | Eide et al. | |
| 2005/0256712 | A1 * | 11/2005 | Yamada et al. | 704/255 |
| 2005/0288923 | A1 | 12/2005 | Kok | |
| 2006/0069561 | A1 * | 3/2006 | Beattie et al. | 704/251 |
| 2006/0072766 | A1 * | 4/2006 | Klein et al. | 381/66 |
| 2006/0122826 | A1 * | 6/2006 | Jiang et al. | 704/205 |
| 2006/0193671 | A1 | 8/2006 | Yoshizawa et al. | |
| 2007/0038455 | A1 * | 2/2007 | Murzina et al. | 704/263 |
| 2007/0100605 | A1 | 5/2007 | Renevey et al. | |
| 2008/0046229 | A1 * | 2/2008 | Maskey et al. | 704/2 |
| 2009/0074195 | A1 | 3/2009 | Cornell et al. | |
| 2009/0105785 | A1 | 4/2009 | Wei et al. | |
| 2009/0220926 | A1 * | 9/2009 | Rechlis | 434/185 |
| 2009/0313024 | A1 | 12/2009 | Black et al. | |
| 2010/0174533 | A1 * | 7/2010 | Pakhomov | 704/205 |
| 2011/0218803 | A1 | 9/2011 | Ketabdar et al. | |
| 2012/0116772 | A1 | 5/2012 | Jones et al. | |
| 2012/0265537 | A1 * | 10/2012 | Deshmukh et al. | 704/271 |

OTHER PUBLICATIONS

International Search Report and Written Opinion of the International Searching Authority mailed May 13, 2013 in related International Application No. PCT/US2013/29242.

(Continued)

*Primary Examiner* — Jialong He
(74) *Attorney, Agent, or Firm* — Scully, Scott, Murphy & Presser, P.C.; Louis J. Percello, Esq.

(57) ABSTRACT

Automatic correcting of user's speech impairment in speech may include obtaining the audio signal of a given user's speech, and analyzing the obtained audio signal to identify artifacts caused by the user's impairment. The obtained audio signal may be modified by eliminating the identified artifacts from it. The modified audio signal may be provided, e.g., to be played or broadcast or transmitted.

8 Claims, 4 Drawing Sheets

(56) References Cited

OTHER PUBLICATIONS

Abyssmedia, AudioRetoucher, 2001-2012, http://www.abyssmedia.com/audioretoucher/.

Logic Pro 9, User Manual, 2009, http://documentation.apple.com/en/logicpro/usermanual/index.html#chapter=17%26section=15%26tasks=true.

Wikipedia, Dynamic range compression, Mar. 12, 2012, http://en.wikipedia.org/wiki/Dynamic_range_compression.

Journal of Speech, Language, and Hearing Research, Evaluation of a Telephone Speech-Enhancement Algorithm Among Older Adults With Hearing Loss, 2011, http://jslhr.asha.org/cgi/content/abstract/54/5/1477.

Journal of Speech, Language, and Hearing Research, Development of a Two-Stage Procedure for the Automatic Recognition of Dysfluencies in the Speech of Children Who Stutter, 1997, http://jslhr.highwire.org/cgi/content/abstract/40/5/1085.

Honal, M. et al., Automatic Disfluency Removal on Recognized Spontaneous Speech—Rapid Adaptation to Speaker-Dependent Disfluencies, 2005 IEEE, ICASSP 2005.

U.S. Office Action mailed Apr. 8, 2013 in related U.S. Appl. No. 13/611,955.

U.S. Notice of Allowance mailed Aug. 21, 2013 in related U.S. Appl. No. 13/611,955.

* cited by examiner

AUTOMATIC REALTIME SPEECH IMPAIRMENT CORRECTION

FIELD

The present application relates generally to computers, and computer applications, and more particularly to automatically correcting audio signals of speech.

BACKGROUND

Audio processing systems exist that attempts to correct the pitch and tempo of a singer, modifying notes sung off key or out of tempo. Other existing audio processing systems automatically control the volume of a given audio signal so that it remains within a given range (not too high or low). Yet others modify speech signals for improved telephone comprehension by older adults. Those systems, however, do not attempt to eliminate artifacts in speech associated with speech impairments such as stuttering while speaking, lisps and vocal ticks that might occur involuntarily.

Techniques for automatic recognition of stutter in speech signals have been explored, but no automatic correction procedure has been described.

Honal and Schultz in "Automatic Disfluency Removal On Recognized Spontaneous Speech-Rapid Adaptation To Speaker-Dependent Disfluencies", IEEE ICASSP 2005, describe a method for removing disfluent words and phrases from an utterance, but this method is applied after the speech signal has been transcribed into text, and does not handle speech impairment at the level of the speech signal.

BRIEF SUMMARY

A method for correcting effects of a user's speech impairment, in one aspect, may include obtaining audio signal of a speech. The method may also include analyzing the audio signal to identify audio signal artifacts caused by the user's speech impairment. The method may further include modifying the audio signal by eliminating the identified audio signal artifacts from the audio signal. The method may also include providing the modified audio signal.

A system for correcting effects of a user's speech impairment, in one aspect, may include a receiver module operable to obtain audio signal of a speech. An analysis module may be operable to execute on the processor and further operable to analyze the audio signal to identify audio signal artifacts caused by the user's speech impairment. A modifier module may be operable to modify the audio signal by eliminating the identified audio signal artifacts from the audio signal. A player module may be operable to provide the modified audio signal.

A computer readable storage medium storing a program of instructions executable by a machine to perform one or more methods described herein also may be provided.

Further features as well as the structure and operation of various embodiments are described in detail below with reference to the accompanying drawings. In the drawings, like reference numbers indicate identical or functionally similar elements.

DETAILED DESCRIPTION

Speech correction in one embodiment of the present disclosure may allow a user to cope with a speech impairment by intercepting their speech, identifying the artifacts of the impairment, eliminating these artifacts and providing the corrected speech, e.g., for broadcasting. In one aspect, audio signal of a user's speech may be obtained. The audio signal is analyzed to identify impairment artifacts, the audio signal is modified to eliminate the identified impairment artifacts, and the modified audio signal is provided as an output to be played. The correcting of the speech in one embodiment of the present disclosure may be performed in real time or near real time, such that that the corrected speech may be broadcast as the user speaks.

Figure 1:
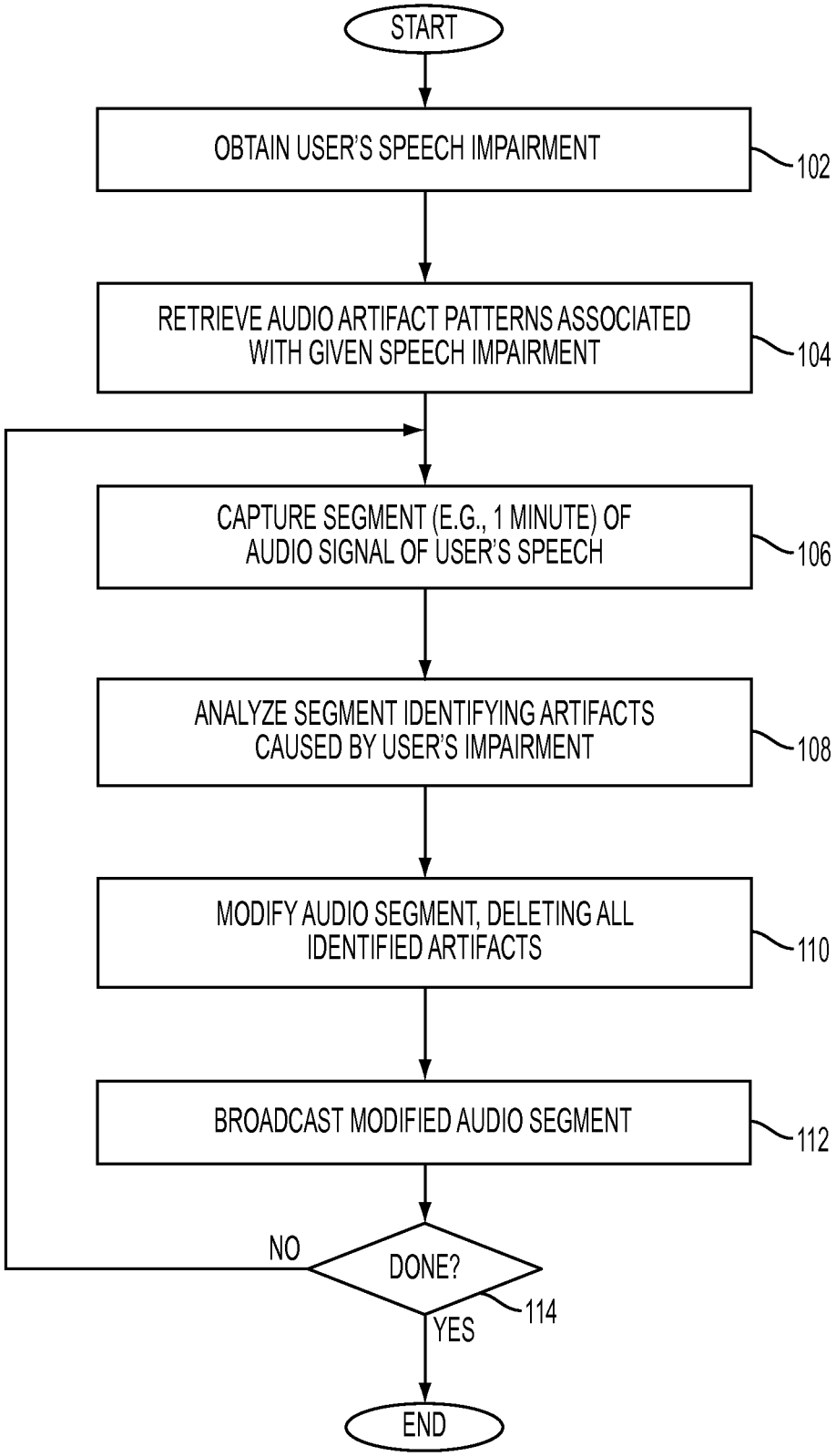
FIG. 1 is a flow diagram illustrating a method of correcting speech in one embodiment of the present disclosure.

FIG. 1 is a flow diagram illustrating a method of correcting speech in one embodiment of the present disclosure. At 102, a specification of user's speech impairment is obtained. For instance, stutters, lisps, involuntary vocalization, or other types that may not be intended as part of speech when a user speaks are identified.

At 104, one or more audio artifact patterns associated with the obtained user's speech impairment are retrieved. The audio artifact patterns, for example, are audio signals or a description or specification of such signals corresponding to the one or more obtained speech impairments, for instance, of the user.

At 106, audio signal of user's speech is captured. In one embodiment of the present disclosure, the capturing may be done incrementally, for example, capturing segments of the audio signal of defined duration or length as the user is speaking. For instance, as the user speaks, the user's speech may be captured in contiguous segments of audio signals of one minute each for processing.

At 108, a captured segment may be analyzed, and one or more artifacts in the captured segment are identified, for example, based on the audio artifact pattern(s) received at 104. For instance, the audio artifact pattern corresponding to the obtained speech impairment is looked for in the audio signals of the captured segment, for example, by comparing the audio signal or specification of the obtained pattern with the audio signals in the captured segment. The matching signals form the identified artifacts.

At 110, the identified artifacts are deleted from the captured audio segment.

At 112, the modified captured segment may be provided, e.g., to be transmitted, played or broadcast as appropriate. For instance, if the method is being utilized in a communication device such as a telephone, cellular telephone, smartphone, or another communication device, the modified captured segment may be provided to be transmitted to the recipient device or the like, for example, over an appropriate network.

At 114, it is determined whether the speech is done. If so, the logic ends, otherwise, the logic returns to 106, where more audio segments are captured and/or analyzed.

The above steps may be performed in real time or near real time as a user is giving a speech. In one aspect, one or more of the processing steps shown may be performed asynchronously, for example, independently from one another. For example, the capturing at 106 may be performed asynchronously with respect to the analyzing 108, modifying 110 and broadcasting 112 steps. So, for instance, segments of the user's speech of defined duration may be captured at 106 and stored, for instance, in a queue (e.g., first-in-first-out data structure or others) in memory. The analyzing 108 and the modifying 110 steps may be performed on the segments retrieved from such queue, even while additional segments are being captured at 106.

Similarly, the processing step at 110 may store the modified audio signal segment as output in a queue or the like, and continue with modifying the next captured segment, without waiting for the modified audio signal segment to be provided appropriately at 112. The processing at 112 may retrieve modified segments from such queue and provide the modified audio signal. Further, the processing at 112 may provide the modified segments in a manner such that the segments making up the speech are broadcast or played in relatively even time intervals, for example, so as to avoid unnatural time gaps between the segments of the speech being broadcast.

In another aspect, the above steps may be performed based on already recorded full speech of a user.

Figure 2:
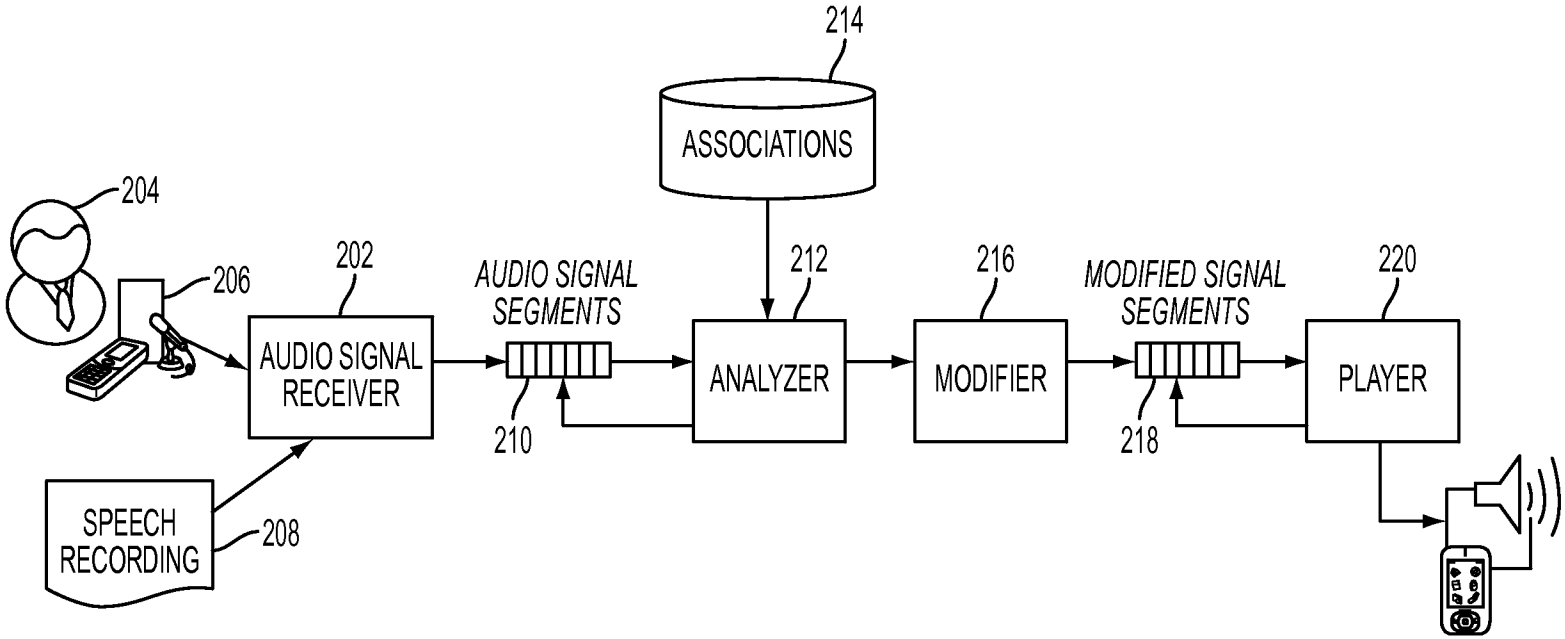
FIG. 2 is a block diagram illustrating components and pipeline of the present disclosure in one embodiment.

FIG. 2 is a block diagram illustrating components and pipeline of the present disclosure in one embodiment. An audio signal receiver or capture module 202 may obtain segments of audio signal. The audio signal receiver module 202, for example, may capture signals transmitted via a microphone 204 or like device as a user 206 is speaking into the microphone 204 or the like device. For instance, the audio signal receiver module 202 may capture a minute's duration or another interval of time duration of the user's speech, and for example, place that segment of speech in a queue or the like 210. The audio signal receiver module 202 may also directly transmit the captured segment to the analyzer module 212. The audio signal receiver module 202 continues to capture the next minute's (or another) duration of the user's speech, adds the captured segment to the queue or the like 210, or transmits directly to the analyzer module 212. This process capturing the segments may continue as the user 206 speaks and until the user's speech is finished.

In another aspect, the audio signal receiver module 202 may capture the segments of audio signal from a file that contains the recorded data 208.

The analyzer module 212 may receive and analyze the captured audio signal segment. The analyzer module 212 looks for audio signal artifacts that correspond to the parts of the speech, for example, caused by the user's speech impairment. In this respect, the analyzer module 212 may obtain association of the audio signal artifacts to the user's speech impairment, for instance, from a database or the like containing such associations 214. For example, this particular user 206 may stutter when speaking. An audio signal artifact that represents or corresponds to the user's stutter may be retrieved from the database 214 and compared to the captured audio signal segment. In one embodiment of the present disclosure, the associations 214 may include specific audio signal artifacts associated with a particular user's speech impairment. The associations 214 may also include audio signal artifacts associated with particular speech impairments in general, not specifically associated with a particular user. So, for example, if the user at 206 has a stutter, but the association of this specific user's stutter and audio signal artifact is not found in the database 214, the analyzer module 212 may utilize an audio signal artifact associated with generic stutter characteristics. If the captured audio signal segment contains one or more artifacts caused by the user's speech impairment or like, the captured audio signal segment may be modified by removing the identified artifacts from the captured segment. For example, the analyzer module 212 may communicate the identified artifacts in the captured audio signal segment to a modifier module 216, which may perform the deleting of the artifacts from the capture audio signal.

The modifier module 216 may delete the identified artifacts in the captured audio signal segment. For example, the identification may occur in the form of offsets; e.g., audio signal data in the captured segment that is between the identified time intervals may be removed. The modified audio signal segment may be then provided to be played to be heard, for example, broadcast. In one aspect, the modifier module 216 may store or place the modified data in a queue 220 in memory or the like, for a player module 218 to retrieve for transmitting and/or playing.

The player module 218 provides, for example, for broadcasting or playing, the modified audio signal segment. In one aspect, the player module 218 may retrieve a segment to provide from a queue and provide it, continuing with retrieving and providing the next available segment in the queue. In this manner in one embodiment of the present disclosure, no one module need be held up waiting for data from another module in the processing pipeline. In addition, the segments may be provided in a manner such that the broadcast or playing of the entire speech may be unbroken, and for example, there are no long or intermittent intervals of silence between the playing of the segments, for example, when a recipient of the speech hears it.

One or more of the modules shown in FIG. 2 may be executed on one or more processors or processing elements, may be stored in memory and loaded onto the one or more processors for executing. In another aspect, one or more of the modules may be programmed into an integrated circuit to perform the functionalities described above.

The database of associations 214 may include target impairments and associated audio signal artifacts. For instance, a user's stutter may be associated with audio signal pattern, also referred to as audio signal artifact. An example of impairment to audio signal artifact association may be, for stutter, repeated instances of given phonemes associated with stuttering. Another example may include, for Tourete Syndrome, whoops (or inappropriate verbiage) inserted into speech. Yet another example association may include, for lisping, slurred pronunciation. Thus, for example, if a given user has stutter, the analyzer module 212 based on the association may look for repeated instances of a given phoneme in the user's speech. The database 214 may include such impairment to audio signal artifact associations. The database 214 also may include knowledge base of users, for example, which user has what impairments. In one embodiment of the present disclosure, one or more audio signal artifacts associated with an impairment may be specified as a description or specification of what to look for to detect the associated impairment in a speech (e.g., repeated instances of a given phoneme), or an example of actual signal patterns (e.g., a pre-recording of signal pattern or the like), or combinations thereof.

The associations of user's speech impairment to corresponding audio signal artifact may be generated based on user's input or training. For example, a particular user may input impairment to audio signal pattern correspondence specific to that user. The user may listen to a recording of the user's own speech, and then indicating which audio signals are artifacts. As another example, an automated system may be trained to recognize audio signal artifacts associated with a user based on comparing audio signals associated with the user's speech with an exemplary audio signal of the same speech. For instance, audio signals of a known text passage may be generated, and compared with the audio signal of the user reading the same text passage.

The speech impairment referred to in the present disclosure may include, but are not limited to, stuttering, those caused by Tourete Syndrome, a condition which causes involuntary vocal sounds, lisping, and others.

The methodologies of the present disclosure may provide correction of speech defect artifacts caused by known impairment (e.g., stuttering) in real time or near real time, for example, by capturing, analyzer and deleting those audio artifacts. The processing of the audio signals may utilize known signal processing techniques.

Figure 3:
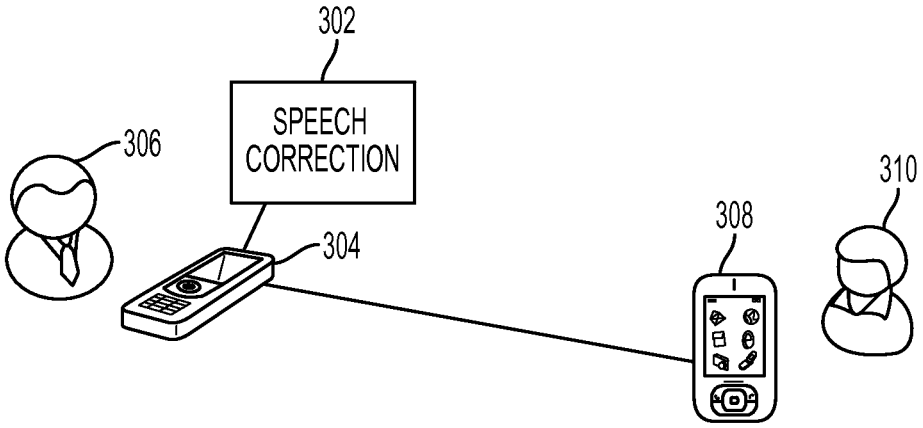
FIG. 3 illustrates an example usage scenario for a method of the present disclosure in one embodiment of the present disclosure.

FIG. 3 illustrates an example usage scenario of the speech correction methodology of the present disclosure in one embodiment. The speech correction methodology of the present disclosure may be implemented as an application or the like 302 on a device 304 such as a smartphone, a cellular phone, or another communication device. When a first user 306 calls a second user 310 and speaks on the device, the application or the like 302 running on the device 304 may intercept the first user's speech or audio signals before they are transmitted to the second user's device 308, and eliminate artifacts in the speech caused by the first user's speech impairment in near real time, for example, as disclosed herein. The device 302 may then transmit or broadcast the corrected audio signal to the second user's device 308. The second user 310 would hear the first user speaking without the speech impairments. The user's speech impairment specification and/or the association of impairment to artifact data used for comparison may be stored locally with the device 302, or may be obtained or retrieved from a remote database storage or the like.

Figure 4:
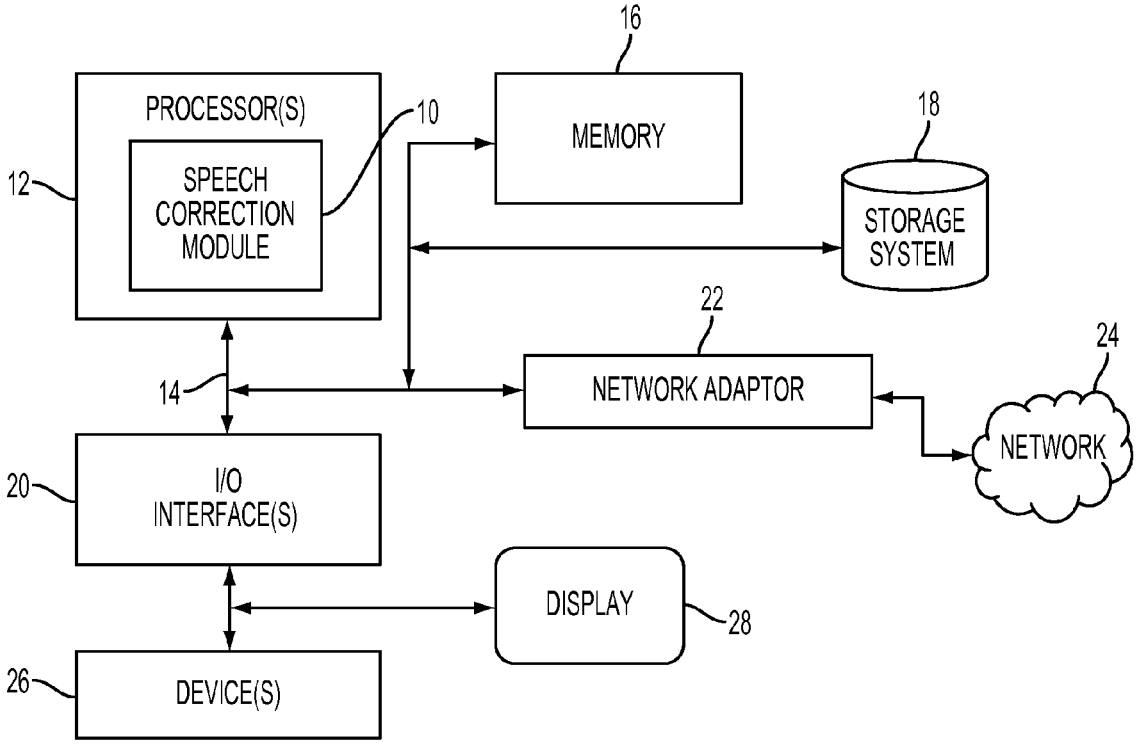
FIG. 4 illustrates a schematic of an example computer or processing system that may implement the real time speech impairment system in one embodiment of the present disclosure.

FIG. 4 illustrates a schematic of an example computer or processing system that may implement the real time speech impairment system in one embodiment of the present disclosure. The computer system is only one example of a suitable processing system and is not intended to suggest any limitation as to the scope of use or functionality of embodiments of the methodology described herein. The processing system shown may be operational with numerous other general purpose or special purpose computing system environments or configurations. Examples of well-known computing systems, environments, and/or configurations that may be suitable for use with the processing system shown in FIG. 4 may include, but are not limited to, smart cell phones (e.g., the iPhone or the Adroid), personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

The computer system may be described in the general context of computer system executable instructions, such as program modules, being executed by a computer system. Generally, program modules may include routines, programs, objects, components, logic, data structures, and so on that perform particular tasks or implement particular abstract data types. The computer system may be practiced in distributed cloud computing environments where tasks are performed by remote processing devices that are linked through a communications network. In a distributed cloud computing environment, program modules may be located in both local and remote computer system storage media including memory storage devices.

The components of computer system may include, but are not limited to, one or more processors or processing units 12, a system memory 16, and a bus 14 that couples various system components including system memory 16 to processor 12. The processor 12 may include a speech correction module 10 that performs the methods described herein. The module 10 may be programmed into the integrated circuits of the processor 12, or loaded from memory 16, storage device 18, or network 24 or combinations thereof.

Bus 14 may represent one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system may include a variety of computer system readable media. Such media may be any available media that is accessible by computer system, and it may include both volatile and non-volatile media, removable and non-removable media.

System memory 16 can include computer system readable media in the form of volatile memory, such as random access memory (RAM) and/or cache memory or others. Computer system may further include other removable/non-removable, volatile/non-volatile computer system storage media. By way of example only, storage system 18 can be provided for reading from and writing to a non-removable, non-volatile magnetic media (e.g., a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 14 by one or more data media interfaces.

Computer system may also communicate with one or more external devices 26 such as a keyboard, a pointing device, a display 28, etc.; one or more devices that enable a user to interact with computer system; and/or any devices (e.g., network card, modem, etc.) that enable computer system to communicate with one or more other computing devices. Such communication can occur via Input/Output (I/O) interfaces 20.

Still yet, computer system can communicate with one or more networks 24 such as a local area network (LAN), a general wide area network (WAN), and/or a public network (e.g., the Internet) via network adapter 22. As depicted, network adapter 22 communicates with the other components of computer system via bus 14. It should be understood that although not shown, other hardware and/or software components could be used in conjunction with computer system. Examples include, but are not limited to: microcode, device drivers, redundant processing units, external disk drive arrays, RAID systems, tape drives, and data archival storage systems, etc.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages, a scripting language such as Perl, VBS or similar languages, and/or functional languages such as Lisp and ML and logic-oriented languages such as Prolog. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The computer program product may comprise all the respective features enabling the implementation of the methodology described herein, and which—when loaded in a computer system—is able to carry out the methods. Computer program, software program, program, or software, in the present context means any expression, in any language, code or notation, of a set of instructions intended to cause a system having an information processing capability to perform a particular function either directly or after either or both of the following: (a) conversion to another language, code or notation; and/or (b) reproduction in a different material form.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements, if any, in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Various aspects of the present disclosure may be embodied as a program, software, or computer instructions embodied in a computer or machine usable or readable medium, which causes the computer or machine to perform the steps of the method when executed on the computer, processor, and/or machine. A program storage device readable by a machine, tangibly embodying a program of instructions executable by the machine to perform various functionalities and methods described in the present disclosure is also provided.

The system and method of the present disclosure may be implemented and run on a general-purpose computer or special-purpose computer system. The terms "computer system" and "computer network" as may be used in the present application may include a variety of combinations of fixed and/or portable computer hardware, software, peripherals, and storage devices. The computer system may include a plurality of individual components that are networked or otherwise linked to perform collaboratively, or may include one or more stand-alone components. The hardware and software components of the computer system of the present application may include and may be included within fixed and portable devices such as desktop, laptop, and/or server. A module may be a component of a device, software, program, or system that implements some "functionality", which can be embodied as software, hardware, firmware, electronic circuitry, or etc.

The embodiments described above are illustrative examples and it should not be construed that the present invention is limited to these particular embodiments. Thus, various changes and modifications may be effected by one skilled in the art without departing from the spirit or scope of the invention as defined in the appended claims.

We claim:

1. A method for correcting effects of a user's speech impairment, comprising:

obtaining audio signal of a speech;

analyzing, by a processor, the audio signal to identify audio signal artifacts caused by the user' s speech impairment;

modifying, by the processor, the audio signal by eliminating the identified audio signal artifacts from the audio signal based on a database of impairment-to-artifact associations; and providing the modified audio signal;

wherein the database of impairment-to-artifact associations including repeated instances of phonemes associated with stuttering, inappropriate verbiage inserted into speech associated with Tourete Syndrome, and slurred pronunciation associated with lisping, wherein the analyzing further comprises identifying the audio signal artifacts caused by the user's speech impairment by employing identified differences between audio signals of the user reading a text with a predefined audio signal associated with the text.

2. The method of claim 1, wherein the method is performed in real time or near real time as the speech is being made.

3. The method of 1, wherein the providing includes transmitting the modified signal or playing the modified audio signal or combinations thereof.

4. The method of claim 1, wherein the method is performed in real time while the speech is being made, and the obtaining and the providing occur continuously, with a next speech audio being obtained while previously modified audio signal is provided.

5. The method of claim 1, wherein the speech impairment includes stuttering, Tourete Syndrome, or lisping, or combinations thereof.

6. The method of claim 1, further including:

receiving training of which audio signals are artifacts caused by the user's speech impairment.

7. The method of claim 6, wherein the receiving training includes receiving user's indication of which audio signals are artifacts associated with the user's speech impairment.

8. The method of claim 6, wherein the receiving training includes:

receiving audio signals of a user reading a text;

comparing the audio signals of the user reading the text with a predefined audio signal associated with the text; and identifying the audio signal artifacts associated with the user's speech impairment by identifying differences between the audio signals of the user reading the text with a predefined audio signal associated with the text.

* * * * *